United States Patent [19]

Zunick

[11] 4,150,270

[45] Apr. 17, 1979

[54] ENCAPSULATED HIGH VOLTAGE SWITCHING DEVICE

[75] Inventor: Michael J. Zunick, Greendale, Wis.

[73] Assignee: McGraw-Edison Company, Elgin, Ill.

[21] Appl. No.: 660,068

[22] Filed: Feb. 23, 1976

[51] Int. Cl.[2] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,123,698 | 3/1964 | Waterton | 200/144 B |
| 3,471,669 | 10/1969 | Curtis | 200/144 B |
| 3,855,435 | 12/1974 | Himi | 200/144 B |
| 3,956,721 | 5/1976 | Link | 200/144 B |

FOREIGN PATENT DOCUMENTS

| | | | |
|---|---|---|---|
| 2353141 | 5/1974 | Fed. Rep. of Germany | 200/144 B |
| 2402472 | 8/1974 | Fed. Rep. of Germany | 200/144 B |

*Primary Examiner*—Robert S. Macon

*Attorney, Agent, or Firm*—Jon Carl Gealow; Ronald J. LaPorte; Thomas E. McDonald

[57] ABSTRACT

An interrupter includes a vacuum enclosure for a set of high voltage contacts and end contact assemblies are secured to the end walls. High voltage terminals are connected to the contact assemblies. A solid insulating shell intimately attaches to the vacuum enclosure and extends axially therefrom to enclose the contact assemblies, with a contact shaft passageway in one end of the shell. One of the contact assemblies includes a movable contact shaft extending through the passageway in the insulating shell to an operating mechanism for rapid opening of the contacts. The passageway is sealed at the outer end to the shaft with a rolling diaphragm and defines a chamber encompassing the contact assembly. A deaerated insulating oil fills the chamber and significantly increases the impulse voltage rating of the interrupter. The chamber may alternatively be filled with a non-pressurized sulfur hexafluoride or other suitable gaseous medium to prevent contamination. A pressurized gaseous medium may also be used and increases the impulse voltage capability of the unit. If a pressurized medium is employed, the diaphragm is spring loaded to prevent ballooning.

10 Claims, 3 Drawing Figures

ENCAPSULATED HIGH VOLTAGE SWITCHING DEVICE

BACKGROUND OF THE INVENTION

This invention relates to an encapsulated high voltage switching device such as a vacuum fault interrupter having a movable contact rod in sliding contact with a high voltage contact and terminal assembly.

In residential power distribution systems and the like, circuit interrupters are incorporated into the system to provide automatic protection in response to abnormal load or line conditions and to permit manual opening and closing of the circuit. The interrupters may advantageously seal the contacts in a vacuum enclosure with a movable contact having an operating contact rod extending through a vacuum seal in one end of the enclosure. A particularly satisfactory encapsulated interrupter is disclosed in the copending application of Kumbera et al, entitled "PROTECTIVE SWITCH DEVICE AND OPERATING MECHANISM THEREFOR," filed on Mar. 6, 1975, with Ser. No. 555,948, and assigned to the same assignee as this application. As more fully disclosed therein, the vacuum interrupter advantageously includes an outer solid, thick insulating wall or shell case in intimate contact with the vacuum enclosure to form a self-supporting unit within which a fixed contact assembly and a movable contact assembly are disposed. High voltage current exchange assemblies are provided for connecting of the contact assemblies in circuit. The movable contact includes an operating rod or shaft projecting outwardly of the encapsulating insulating wall and sliding through a pair of circuit contact springs in the high voltage current exchange assembly which are case into the shell to maintain an integral outer wall member with the single opening from which the movable contact extends in a sealed manner.

The current exchange assemblies are specially formed to distribute or grade the high voltages in the connection and essentially eliminate high stress of the insulation. As disclosed in the above-entitled application, an operating guide member of suitable insulating material preferably lines the rod opening to extend concentrically of the operating member and functions to prevent high voltage tracking along such opening. A conductive layer may also be provided extending along the outer surface of the guide tube from the current exchange assembly to distribute the field and prevent high stress on the insulation.

Although the encapsulated vacuum fault interrupter has been found to provide a highly reliable, lightweight fault interrupter having a long life and minimum service requirements, recent demands for still higher impulse voltage ratings require further improvement in the termination or connection capability, particularly in the sliding connection of the movable contact.

SUMMARY OF THE PRESENT INVENTION

The present invention is particularly directed to an encapsulated power switch device having an inner enclosure from which a high voltage moving contact member is movably mounted and having a fixed high voltage terminal assembly connected to said contact member within an outer encapsulating, insulating shell having an elongated passageway through which the contact member extends. In accordance with the teaching of the present invention, the passageway is larger than the contact member and defines an encircling chamber, which is sealed and filled with a high voltage insulating fluid medium which minimizes high electrical stress points or areas at the high voltage terminal assembly. The structure of the invention thereby eliminates creation of damaging and destructive ionized air columns which produce a conductive path to ground. In a particularly unique construction of the present invention, a deaerated insulating oil is employed to fill the wall or chamber within the encapsulating insulating shell. The liquid may be retained at atmospheric pressure. Transformer oil provide a suitable insulating medium where the minimum temperature specification will be zero degrees centigrade. Lower temperatures can be readily accommodated by employing special low temperature insulating fluids such as silicone oils and the like.

In a particularly unique and practical construction, the movable contact member is a contact rod slidably mounted within a high voltage current interchange assembly. The contact rod extends coaxially, outwardly through an opening in the encapsulated outer shell. The chamber from the vacuum enclosure outwardly through the opening is filled with a deaerated insulating oil with the outer end of the opening sealed to the shaft by a rolling flexible diaphragm. Where silicone oils are employed the seal means such as the diaphragm must, of course, be constructed to be compatible therewith and thus maintaining their flexibility at the minimum working temperatures.

The inventor has particularly found that the combination of the previous contact springs and stress relieving high voltage current interchange assembly in combination with a sealed encompassing chamber filled with a suitable insulating medium significantly increases the basic impulse level capability of the encapsulated vacuum interrupter or switch device.

Other fluid mediums may also be employed, some of which may not extend voltage rating of the switch device but may, nevertheless, contribute to the life of the switching device. For example, well-known sulfur hexafluoride at ambient pressures can be sealed within the chamber. The fluid medium will prevent moisture condensation and other contamination, thereby maintaining the original impulse voltage level rating for the life of the interrupter. If the sulfur hexafluoride is pressurized, it will further increase the voltage impulse level rating of the interrupter. If a pressurized system is employed, suitable means should be provided with the diaphragm to prevent ballooning of the diaphragm.

The present invention thus provides a simple, reliable and inexpensive apparatus for improving the life and rating of high voltage encapsulated switching devices.

BRIEF DESCRIPTION OF THE DRAWING

The drawing furnished herewith illustrates the best mode presently contemplated by the inventor and clearly disclose the above advantages and features, as well as others, which will be readily understood from the detailed description thereof.

In the drawing.

DESCRIPTION OF THE ILLUSTRATED EMBODIMENTS

Figure 1:
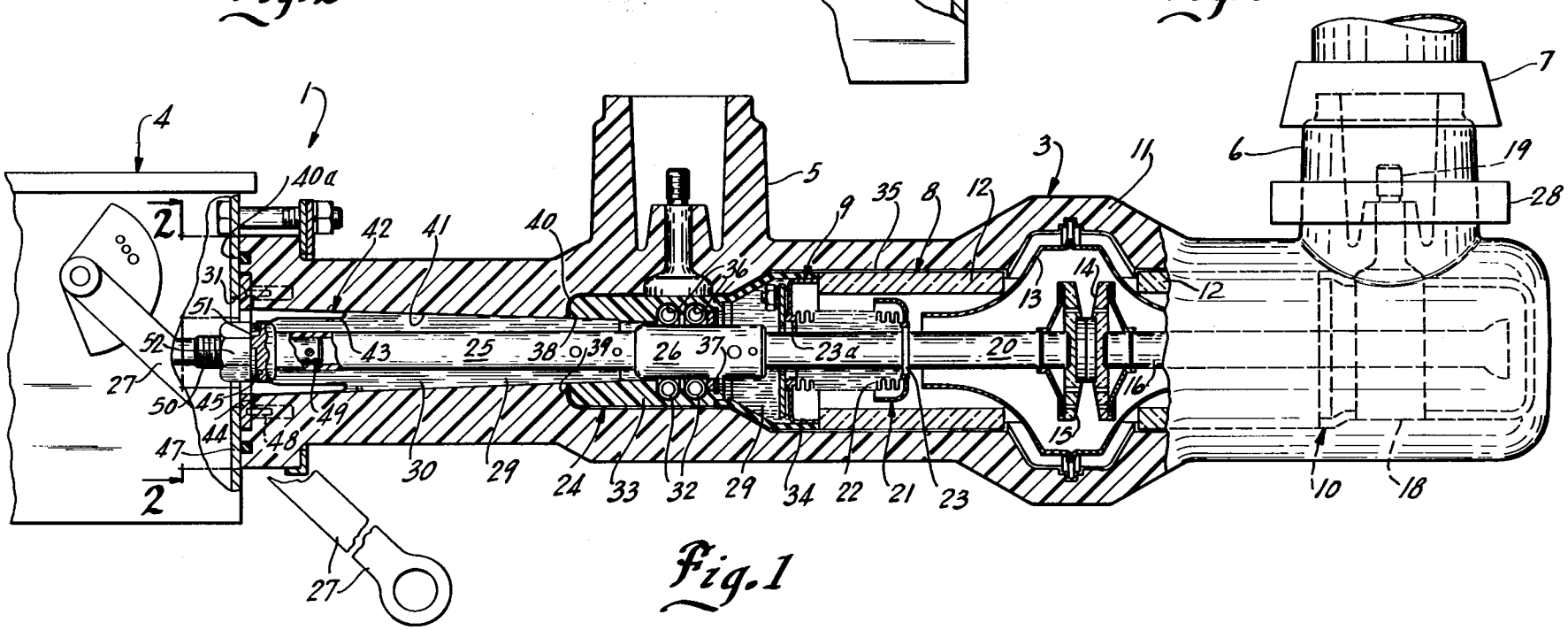
FIG. 1 is a vertical section through an encapsulated high voltage switching device constructed in accordance with the teaching of this invention.
Figure 2:
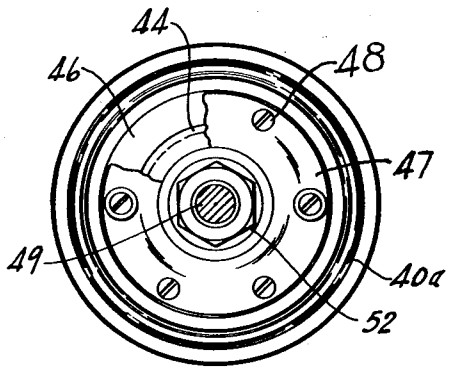
FIG. 2 is a sectional view taken generally on line 2—2 of FIG. 1.

Referring to the drawings and particularly to FIG. 1, a submersible protective switch device 1 is shown of construction adapted to be mounted within a below ground vault, not shown. Device 1 is of a generally elongated construction having an interrupter unit 3, constructed in accordance with the teaching of the present invention, attached in sealed relation at one end to an operating unit 4 to create a waterproof assembly. The interrupter unit 3 includes a pair of spaced high voltage contact bushing 5 and 6 for securing to power line connectors 7 and operable to open and close the circuit.

The illustrated interrupter unit 3 includes a vacuum enclosure 8 with end connector cap units 9 and 10 cast and encapsulated within an outer solid insulation housing or shell 11 to form an integrated self-supporting structure. The vacuum enclosure 8, in accordance with usual practice, includes a pair of tubular insulators 12 with a centrally located contact shield assembly 13 mounted therebetween. A pair of power interrupt contacts 14 and 15 are located centrally of the assembly 13. Contact 14 is a fixed contact having a contact rod 16 extending coaxially through one end cap unit 10.

The fixed contact rod 16 is connected to a fixed high voltage current interchange assembly generally referred to as the stationary end of the interrupter. The assembly includes a threaded stud 19 within the bushing 6 to receive a line connector.

The movable contact 15 is permanently attached to a movable contact rod 20 extending coaxially through a suitable vacuum seal unit 21 such as a thin metal bellows 22. The bellows 22 is shown mounted in a known manner with one end sealed to the movable rod 20 as at 23 and the opposite end sealed to the end wall 23*a* of the enclosure 8. The inner end of the bellows 22 thus moves with the rod 20, collapsing and expanding to maintain the vacuum within the enclosure 8. The rod 20 is secured to a high voltage current interchange assembly 26. An insulating rod or shaft 25, formed of a suitable high voltage insulating material, such as a filament wound epoxy, is connected to the rod 20 by a sliding metal connector 26. Shaft 25 is connected to the operating mechanism of unit 4 to provide for the selective opening and closing of the contacts 14–15 within the vacuum enclosure 8.

The operating unit 4 may include a manual operating handle 27 extending from unit 4 for manual opening and closing of the interrupter unit 3 and a suitable electromagnetic, not shown, connected by a suitable circuit to a current pick-up 28 is secured to one of the bushings 5–6 to provide a signal responsive to fault line condition. The operating device 4 provide a quick close-quick open operating mechanism with energy for the proposed function stored in a pair of extension springs in response to the manual closing of the contacts 14–15. Once closed the apparatus can be opened, electrically or manually. In either position, a spring-loaded mechanism, now shown, operates to provide a rapid and positive movement of the movable contact unit 15.

The present invention is particularly directed to the construction of a movable contact assembly of the interrupter unit 3 which may otherwise be constructed in any suitable form for connection to a suitable operating mechanism. The present invention is particularly directed to providing a sealed chamber 29 which is filled with an insulating fluid medium 30 of appropriate characteristic to fill all space between the high voltage contact and terminal assembly 24 and the outer insulating housing or shell 11. As more fully discussed, hereinafter, the inventor has found that the insulating medium significantly increases the basic impulse voltage level (BIL) rating of a high voltage interrupter.

The illustrated vacuum interrupter 3 and operating device 4 may otherwise be of any suitable construction. For example, the construction disclosed in the above previously identified copending application provides highly satisfactory results. Consequently, no further description of the operating device or of the other portions or the interrupter unit 3 is described herein other than as necessary to clearly and fully describe the illustrated embodiment of the present invention.

More particularly, the connector 26 of current interchange assembly 24 is a tubular member telescoped over the movable contact rod 20 and pinned thereto. The operating rod or shaft 25 extends into the opposite end of connector 26 and is also pinned thereto. The operating shaft 25 projects coaxially outwardly to the operating unit 4 through an opening 31, for automatic or manual positioning of the contact 15.

The connector 26 is also mounted in sliding engagement within a pair of coil spring contacts 32 and providing sliding connection for one side of the high voltage current path. The coils 32 are secured within a cylindrical conductive member 33 having an integral threaded terminal within bushing 5, generally as disclosed in the above-identified application. An insulating spacer 34 is located between the conductive member 33 and the end seal wall 23*a* of the vacuum enclosure to provide a smooth continuous surface and to minimize current flow through the bellows 22. The outer surfaces of spacer 34 and conductive member 33 have an intimate high resistive paint 35 to limit high stress points and prevents damaging bulk current flow along the spacer 34 to the cap unit 9 and bellows 22 to the movable rod 20 of the vacuum enclosure 8.

The conductive member 33 has an internal diameter somewhat slightly larger than the contact member 26 and includes closely spaced, annular recesses 36 on the interior within which individual conductive coil springs 32 are located in sliding contact with contact member 26.

The coil springs 32 are mechanically retained within the inner recesses by a suitable spacer and retainer ring 37. The interior of the cylindrical member 33 is stepped with a generally centrally located reduced opening forming a stop wall for the adjacent spring 32 and a somewhat larger end opening 38 through which the tubular operating rod 25 extends. The member 33 is a tubular member with an essentially constant outer diameter and with the outermost end 39 connected to the side wall by a smooth, curved corner surface 40. The curved surface 40, of course, minimizes formation of high electrical stress points.

The outer insulating shell 11 is cast about the assembly with the outer end formed as a flat mounting wall 40*a* and includes a passageway 41 extending outwardly from the current interchange assembly 24. The passageway 41 defines the outer portion of well or chamber 29 which extends from the end of the vacuum enclosure 8 to the mounting wall 40*a*. The passageway 41 in the shell 11 is formed as a continuation of the opening 38 through which connector 26 extends and is tapered such as to define a slightly enlarged chamber portion 29 surrounding the insulating rod or shaft 25 at the exit end.

In accordance with the present invention, the chamber 29 is completely filled with the insulating fluid medium 30 and the outer end of the chamber is sealed to the shaft by suitable sealing means 42 secured between the shell and the contact shaft to confine the fluid medium within the chamber. The fluid medium 30 is a suitable high voltage insulating medium and may advantageously be a deaerated insulating oil which increases the BIL capacity or rating of the switching unit 3. The oil particularly encompasses the high voltage current interchange assembly and minimizes the high voltage stresses created at the outermost end of the cylindrical conductive member 33. Thus, a deaerated insulating oil eliminates air paths between the high voltage terminal elements and grounded portions which, in the prior art, appeared to be ionized by the high voltage stresses at the member 33 and resulted in conduction to ground. To ensure that the insulating oil is air free, the chamber is preferably evacuated and back filled with the desired insulating medium. Well-known transformer oils can be employed. More conventional transformer oils are suitable for temperatures above zero degrees centigrade. However, the viscosity of the transformer oil increases with temperature and below 0° C., the viscosity level may be so great as to significantly reduce the speed of the operating rod below a desirable rate and, in some cases, below specified limits. Special oils may be readily found which maintain a suitable viscosity well below 0° C. A silicone oil manufactured and sold by Dow Corning and identified as a Dow Corning 200 Fluid (10 cs viscosity) is particularly desirable where temperatures below 0° C. will be encountered.

Although any suitable seal means 42 can be employed, a preferred, reliable seal means which can be conveniently mounted in the encapsulated interrupter unit 3 is illustrated in FIG. 1 including a rolling diaphragm 43 located within the outer end of the chamber 29 and sealed to the shell 11 and to the shaft 25. More particularly, the diaphragm 43 is of a flexible rubber-like material and is formed as an annular, double wall member having a generally U-shaped cross section forming a convolution encircling the shaft 25 within the chamber 29. The outer ends of the diaphragm are integrally formed with beaded clamping flanges 44 and 45. The mounting end of the insulating shell 11 is recessed as at 46 to receive the beaded flange 44. A clamping plate or washer 47 is secured within the clamping recess 46 by a suitable screw 48 or the like and compresses the beaded flange within the recess to attach the diaphragm with a fluid tight connection.

An end connector member or shaft coupler 49 is pinned or otherwise secured in the outermost end of the insulating tubular shaft 25. Coupler 49 is stepped adjacent a threaded portion 50 with a recess 51 formed in the stepped surface. The inner beaded clamping flange 45 is located within the recess 51 and is clamped in position by a clamping nut and washer 52 threaded on the threaded portion 50 of the coupler 49. The diaphragm flanges are thus tightly clamped and compressed to form fluid tight joints and thereby seal the outer end of the chamber 29 with the diaphragm extending into the chamber.

The other wall of the diaphragm 43 rolls on the adjacent wall surface of the operating shell opening 41. The diaphragm 43 is formed with the inner wall of the diaphragm 43 spaced outwardly of the shaft 25 with the flanged portion 45 shaped to fit over the connector 49. The diaphragm 43 thus seals the outer end of the shell passageway to the operating shaft 25 and holds the insulating oil 30 therein.

The outward movement of the shaft 25 moves the diaphragm 43 outwardly and increases the volume of the chamber 29. However, the sealing bellows 22 collapses with the outward movement of the shaft 25 and reduces the volume of chamber 29 by a corresponding amount. Thus, the chamber 29 is essentially a constant volume to maintain the current interchange assembly 24 immersed in the insulating oil 30.

The diaphragm 43 is selected of a suitable flexible material compatible with the characteristics of the insulating oil and also of a material which maintains a high degree of flexibility at the lowest operating temperature. Buna rubber is suitable where a conventional transformer oil is employed and the unit is designed to operate above zero degrees centigrade. Where special silicone oils are employed such as to operate at lower temperatures, a special diaphragm material should be employed. For example, a highly satisfactory material is that compounded and molded by Minnesota Rubber Co. of Minnesota under the identification of No. EP Material No. 560-ND.

The insulating oil thus completely fills the chamber 29 between the outer end of the opening and the vacuum enclosure 8 to cover the conductive rod assembly and the adjacent portions of the high voltage current exchange assembly.

The insulating oil 30 may be introduced in any desired manner. For example, a vacuum source may be secured to the mounting end with the diaphragm removed. The chamber 29 is evacuated and the deaerated insulating oil introduced in the chamber 29. The vacuum is then removed and the preformed diaphragm 43 introduced into the chamber and sealed to the mounting wall of the shell 11 and to the coupler 49.

Applicant has found that the illustrated embodiment of the invention employing a deaerated silicone oil to fill the chamber can produce an encapsulated vacuum interrupter with a BIL rating of 125 KV. Generally, the limiting factor was found to reside in the contact connector which breaks down between 130 and 135 KV, depending upon the external atmospheric conditions.

As previously noted, insulating oil is particularly desirable in order to maintain relatively high BIL ratings. However, in the conventional 95 KV BIL rated units, a similar chamber can be formed and filled with the conventional gaseous medium such as sulfur hexafluoride ($SF_6$) employed in puffer type interrupters. Although the gaseous insulating medium, as such, does not significantly increase the BIL rating, the construction creates a dry atmosphere and thereby prevents moisture condensation as well as other contamination within the chamber or well 29 significantly contribute to maintaining the original BIL rating throughout the life of the interrupter. However, if such gaseous medium is also pressurized, the BIL rating will be increased. For example, an $SF_6$ gas at 10 lbs. per sq. inch gage pressure has an electrical insulating value equal to that of oil and increases in value up to approximately 30 psi gage. An embodiment of the invention constructed with a pressurized gaseous medium is illustrated in FIG. 3.

Figure 3:
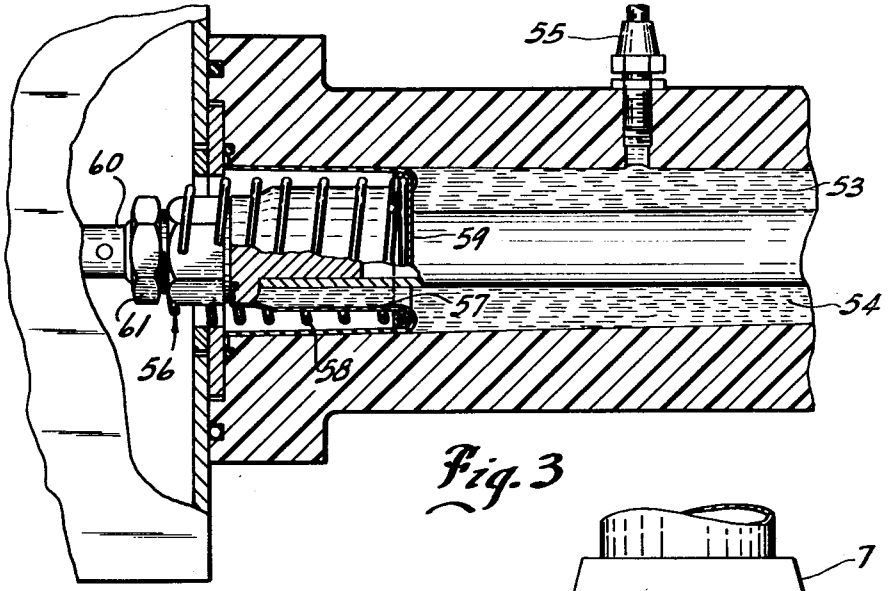
FIG. 3 is a fragmentary view of an interruptor illustrating an alternate embodiment in accordance with the teaching of the present invention.

The interrupter unit of FIG. 3 is constructed essentially as the first embodiment. The chamber 53, however, is filled with a pressurized gaseous medium 54 which functions similar to the insulating oil. A Simple air valve 55 may, for example, be provided in the shell. The pressurized medium 54 tends to force the diaphragm out of the chamber. In FIG. 3, a spring unit 56 is secured within the convoluted diaphragm 57 to prevent the ballooning or blowing out of the diaphragm. The spring unit 56 balances the internal pressure within the chamber and prevents outward movement of the resilient rubber diaphragm as a result of the pressurized gaseous medium.

The illustrated spring unit 56 includes a coil spring 58 located within the diaphragm convolution. The inner end of spring 58 bears on an annular guide plate 59 having a U-shaped cross-section to mate with the inner end of the convolution. The outer end of spring 58 is suitably secured to the threaded rod connector 60 as by a clamping nut 61. As the contact mechanism moves, the spring 58 moves with the insulating rod to permit the rolling action of the diaphragm 57 and thereby the complete filling of the protective well or chamber 53.

Although the embodiment of FIG. 3 is shown with a coil spring, any other suitable means can, of course, be employed. For example, a rubber-like element might be secured to the shaft and project into and fill the convolution in the closed contact position and move outwardly with the insulating rod to permit the rolling action.

The present invention has been found to provide a highly practical response to the demand for increased BIL ratings of encapsulated vacuum interrupters without the necessity for basic changes in the various practical features of present encapsulated interrupter designs.

Various modes of carrying out the invention are contemplated as being within the scope of the following claims, particularly pointing out and distinctly claiming this subject matter which is regarded as the invention.

I claim:

1. A high voltage switch device comprising a vacuum enclosure, a pair of contacts mounted within said enclosure, a first of said contacts being movable relative to the second of said contacts, a conductive operating element connected to said first contact, said conductive operating element slidably connected to a contact member assembly for connection to an external electrical circuit, a vacuum seal means connected to th enclosure and to the element, an outer solid insulation shell encapsulating said enclosure an extending therefrom with a passageway enclosing said element and having an inner wall spaced from said element, a high voltage current interchange assembly embedded within said shell and including a contact means in sliding engagement with said element, an insulating operating element mechanically connected to said conductive operating element, a fluid-tight seal means sealing said passageway to said insulating operating element, said vacuum seal means, said inner wall and said fluid-tight seal means defining a sealed chamber, wherein said vacuum seal means and said fluid-tight seal means oppositely change the volume of said chamber to maintain essentially a constant volume with movement of said insulating operating element, and a fluid insulating medium having a dielectric strength greater than that of air, said medium filling said chamber whereby an operating mechanism mechanically connected to said conductive operating element is electrically insulated therefrom by said insulating operating element and said fluid insulating medium.

2. The switch device of claim 1 wherein said insulating medium is a transformer oil.

3. The switch device of claim 1 wherein said insulating medium is a silicone oil.

4. The switch device of claim 1 wherein said insulating medium is a deaerated insulating oil.

5. The switch device of claim 1 wherein said insulating medium is a gaseous medium.

6. The switch device of claim 5 wherein said chamber is pressurized.

7. The switch device of claim 1 wherein said contact member assembly includes an outer cylindrical contact member concentric of said conductive operating element and constructed to establish a smooth, continuous stress grading surface adjacent the encapsulating shell, said high voltage current interchange assembly includes a sliding contact coil spring means within said contact member and resiliently engaging said conductive operating element, said shell extending coaxially from said cylindrical contact member, and said seal means located in spaced relation to said cylindrical contact member.

8. The switch device of claim 1 wherein said passageway is tapered to enlarge the passageway adjacent the outer end, said fluid-tight seal means including a rolling diaphragm having a convolution encircling said shaft within the chamber and being secured to said shaft and to the passageway.

9. The switch device of claim 8 wherein the insulating medium is a pressurized gas and said rolling diaphragm is spring-loaded to balance the fluid pressure of the medium.

10. The vacuum interrupter of claim 1 wherein said shell terminates in a flat mounting wall adapted to be sealed to an operating mechanism, said mounting wall having an inner clamping recess, said fluid-tight seal means having an outer clamping flange abutting said recess, a clamping member secured to the mounting wall and compressing said outer flange within said recess, said fluid-tight seal means having an inner clamping flange with an opening for said insulating operating member, said insulating operating member having a shoulder portion, and a clamping member secured to said insulating operating member and compressing said inner flange against said shoulder.

* * * * *